US005213635A

United States Patent [19]

Huang

[11] Patent Number: 5,213,635

[45] Date of Patent: May 25, 1993

[54] GAMMA TITANIUM ALUMINIDE RENDERED CASTABLE BY LOW CHROMIUM AND HIGH NIOBIUM ADDITIVES

[75] Inventor: Shyh-Chin Huang, Latham, N.Y.

[73] Assignee: General Electric Company, Schenectady, N.Y.

[21] Appl. No.: 812,393

[22] Filed: Dec. 23, 1991

[51] Int. Cl.[5] ..... C22C 14/00

[52] U.S. Cl. ..... 148/421; 148/670; 420/418; 420/421

[58] Field of Search ..... 148/421; 420/418, 421

[56] References Cited

U.S. PATENT DOCUMENTS

| | | | |
|---|---|---|---|
| 3,203,794 | 8/1965 | Jaffee et al. | 75/175.5 |
| 4,294,615 | 10/1981 | Blackburn et al. | 148/11.5 F |
| 4,639,281 | 1/1987 | Sastry et al. | 148/421 |
| 4,661,316 | 4/1987 | Hashimoto et al. | 420/418 |
| 4,774,052 | 9/1988 | Nagle et al. | 420/590 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,857,268 | 8/1989 | Huang et al. | 420/418 |
| 4,879,092 | 11/1989 | Huang | 420/418 |
| 4,897,127 | 1/1990 | Huang | 148/421 |
| 4,902,474 | 2/1990 | Huang et al. | 420/418 |
| 4,916,028 | 4/1990 | Huang | 420/421 |
| 4,923,534 | 5/1990 | Huang et al. | 420/418 |
| 5,028,491 | 7/1991 | Huang et al. | 148/421 |
| 5,032,357 | 7/1991 | Rowe | 420/418 |
| 5,045,406 | 11/1991 | Huang | 148/421 |

FOREIGN PATENT DOCUMENTS

| | | |
|---|---|---|
| 621884 | 6/1961 | Canada . |
| 0275391 | 12/1987 | European Pat. Off. . |
| 1298127 | 12/1989 | Japan . |
| 2238794 | 6/1991 | United Kingdom . |

OTHER PUBLICATIONS

"Effect of TiB2 Additions on the Colony Size of Near Gamma Titanium Aluminides", J. D. Bryant, L. Christodoulou, J. R. Maisano, Scripta Metallurgica et Materialia, vol. 24, (1990) pp. 33-38.

"Influence of Matrix Phase Morphology on Fracture Toughness in a Discontinuously Reinforced XD Titanium Aluminide Composite", Scripta Metallurgica et Materialia, vol. 24, (1990) pp. 851-856.

"The Effects of Alloying on the Microstructure and Properties of Ti3Al and TiAl", Titanium 80, (published by the American Society of Metals, Warrendale, Pa.), vol. 2 (1980) pp. 1245-1954.

"Deformation and Failure in Titanium Aluminide" S. M. Barinov, Z. A. Samoilenko, Izvestiya Akademii Nauk SSSR, Metally, No. 3, pp. 164-168, 1984.

"Effect of Rapid Solidification in LloTiAl Compound Alloys", ASM Symposium Proceedings on Enhanced Properties in Struc. Metals Via Rapid Solidification, Materials Week (Oct. 1986), pp. 1-7.

"Titanium Aluminides-An Overview", H. A. Lispitt, Mat. Res. Soc. Symposium Proc., Materials Research Society, vol. 39 (1985), pp. 351-364.

"Research, Development, and Prospects of TiAl Inter- (List continued on next page.)

*Primary Examiner*—Upendra Roy

*Attorney, Agent, or Firm*—Paul E. Rochford; James Magee, Jr.

[57] ABSTRACT

A method for providing improved castability in a gamma titanium aluminide is taught. The method involves adding inclusions to the near stoichiometric titanium aluminide and specifically low chromium and high niobium inclusions. Niobium additions are made in concentrations between 6 and 14 atomic percent. Chromium additions are between 1 and 3 atom percent. Property improvements are also achieved.

A preferred composition is according to the following expression:

$$Ti\text{—}i\ Al_{46-48}Cr_{1-3}Nb_{6-14}$$

12 Claims, 2 Drawing Sheets

OTHER PUBLICATIONS metallic Compound Alloys", T. Tsujimoto, Titanium and Zirconium, vol. 33, No. 3, 159 Jul. 1985), pp. 1-19.

"Creep Deformation of TiAl and TiAl+W Alloys", P. L. Martin, M. G. Mendiratta, H. A. Lipsitt, Metallurgical Transactions A, vol. 14A (Oct. 1983), pp. 2171-2174.

"Plastic Deformation of TiAl and Ti3Al" SML Sastry, H. A. Lispsitt, Titanium 80 (Published by American Society for Metals, Warrendale, Pa.), vol. 2, (1980), pp. 1231-1243.

"Titanium-Aluminum System", E. S. Bumps, H. D. Kessler, M. Hansen, Transactions AIME, Journal of Metals, Jun. 1952, pp. 609-614.

"Mechanical Properties of High Purity Ti-Al Alloys", H. R. Ogden, D. J. Maykuth, W. L. Finlay, R. I. Jaffee, Transaction AIME, Journal of Metals, Feb. 1953, pp. 267-272.

"Ti-36 Pct Al as a Base for High Temperature Alloys", J. B. McAndrew, J. H. D. Kessler, Transactions AIME, Journal of Metals, Oct., 1956, pp. 1348-1353.

"Temperature Dependence of the Strength and Fracture Toughness of Titanium Aluminum", Izv. Akad. Nauk SSSR, Met., vol. 5, 1983, p. 170.

GAMMA TITANIUM ALUMINIDE RENDERED CASTABLE BY LOW CHROMIUM AND HIGH NIOBIUM ADDITIVES

CROSS REFERENCES TO RELATED APPLICATIONS

The subject applications relate to copending applications as follows:

Ser. No. 07/354,965; Ser. No. 07/354,965, and Ser. No. 07/354,965, filed May 22, 1989 respectively. Ser. Nos. 07/546,962, and 07/546,973, both filed Jul. 2, 1990; Ser. Nos. 07/589,823, and 07/589,827, both filed Sep. 26, 1990; Ser. No. 07/613,494, filed Jun. 12, 1991; Ser. Nos. 07/631,988, and 07/631,989, both filed Dec. 21, 1990; Ser. No. 07/695,043, filed May 2, 1991; Ser. No. 07/739,004, filed Aug. 1, 1991; and Ser. No. 07/801,556, filed Dec. 2, 1991; Ser. No. 07/801,558, filed Dec. 2, 1991; Ser. No. 07/811,371, filed Dec. 20, 1991; Ser. No. 07/801,557, filed Dec. 2, 1991.

The text of these related applications are incorporated herein by reference.

BACKGROUND OF THE INVENTION

The present invention relates generally to gamma titanium aluminide (TiAl) alloys having improved castability as well as improved strength and ductility. More particularly, it relates to castings of TiAl doped by low chromium and high niobium.

In forming a casting, it is generally desirable to have highly fluid properties in the molten metal to be cast. Such fluidity permits the molten metal to flow more freely in a mold and to occupy portions of the mold which have thin dimensions and also to enter into intricate portions of the mold without premature freezing In this regard, it is generally desirable that the liquid metal have a low viscosity so that it can enter portions of the mold having sharp corners and so that the cast product will match very closely the shape of the mold in which it was cast.

It is also desirable that the castings have good combinations of strength and ductility properties.

With regard to the titanium aluminide itself, it is known that as aluminum is added to titanium metal in greater and greater proportions, the crystal form of the resultant titanium aluminum composition changes. Small percentages of aluminum go into solid solution in titanium and the crystal form remains that of alpha titanium At higher concentrations of aluminum (including about 25 to 30 atomic percent), intermetallic compound $Ti_3Al$ forms and it has an ordered hexagonal crystal form called alpha-2. At still higher concentrations of aluminum (including the range of 50 to 60 atomic percent aluminum) another intermetallic compound, TiAl, is formed having an ordered tetragonal crystal form called gamma. The gamma titanium aluminides are of primary interest in the subject application.

The alloy of titanium and aluminum having a gamma crystal form and a stoichiometric ratio of approximately 1, is an intermetallic compound having a high modulus, low density, a high thermal conductivity, a favorable oxidation resistance, and good creep resistance. The relationship between the modulus and temperature for TiAl compounds to other alloys of titanium and in relation to nickle base superalloys is shown in FIG. 2. As is evident from the Figure, the gamma TiAl has the best modulus of any of the titanium alloys. Not only is the gamma TiAl modulus higher at higher temperature, but the rate of decrease of the modulus with temperature increase is lower for gamma TiAl than for the other titanium alloys. Moreover, the gamma TiAl retains a useful modulus at temperatures above those at which the other titanium alloys become useless Alloys which are based on the TiAl intermetallic compound are attractive, light-weight materials for use where high modulus is required at high temperatures and where good environmental protection is also required.

It is recognized that if the product is forged or otherwise mechanically worked following the casting, the microstructure can be altered and may be improved.

What is also sought and what is highly desirable in a cast product is a minimum ductility of more than 0.5%. Such a ductility is needed in order for the product to display an adequate integrity. A minimum room temperature strength for a composition to be generally useful is about 50 ksi or about 350 MPa. However, materials having this level of strength are of marginal utility and higher strengths are often preferred for many applications.

The stoichiometric ratio of gamma TiAl compounds can vary over a range without altering the crystal structure. The aluminum content can vary from about 50 to about 60 atom percent. However, the properties of gamma TiAl compositions are subject to very significant changes as a result of relatively small changes of 1% or more in the stoichiometric ratio of the titanium and aluminum ingredients. Also, the properties are similarly affected by the addition of relatively small amounts of ternary and quaternary elements as additives or as doping agents.

One of the attributes which is sought in a titanium aluminide is the capability for the aluminide to be cast into desirable shapes and forms and to have a desirable set of properties in the as-cast form or the ability to acquire a desirable set of properties with a minimal processing of the as-cast material.

PRIOR ART

There is extensive literature on the compositions of titanium aluminum including the $TiAl_3$ intermetallic compound, the gamma TiAl intermetallic compounds and the $Ti_3Al$ intermetallic compound. A patent, U.S. Pat. No. 4,294,615, entitled "Titanium Alloys of the TiAl Type" contains an intensive discussion of the titanium aluminide type alloys including the gamma TiAl intermetallic compound. As is pointed out in the patent in column 1, starting at line 50, in discussing the advantages and disadvantages of gamma TiAl relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the gamma alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resembles that of titanium, as the hexagonal crystal structures are very similar. However, the compound TiAl has a tetragonal arrangement of atoms and thus rather different alloying characteristics. Such a distinction is often not recognized in the earlier literature."

A number of technical publications dealing with the titanium aluminum compounds as well as with characteristics of these compounds are as follows:

1. E. S. Bumps, H. D. Kessler, and M. Hansen, "Titanium-Aluminum System", Journal of Metals, June, 1952, pp. 609-614, TRANSACTIONS AIME, Vol. 194.
2. H. R. Ogden, D. J. Maykuth, W. L. Finlay, and R. I. Jaffee, "Mechanical Properties of High Purity Ti-Al Alloys", Journal of Metals, February, 1953, pp. 267-272, TRANSACTIONS AIME, Vol. 197.
3. Joseph B. McAndrew and H. D. Kessler, "Ti-36 Pct Al as a Base for High Temperature Alloys", Journal of Metals, October, 1956, pp. 1345-1353, TRANSACTIONS AIME, Vol. 206.
4. S. M. Barinov, T. T. Nartova, Yu L. Krasulin and T. V. Mogutova, "Temperature Dependence of the Strength and Fracture Toughness of Titanium Aluminum", Izv. Akad. Nauk SSSR, Met., Vol. 5, 1983, p. 170.

In reference 4, Table I, a composition of titanium-36 aluminum −0.01 boron is reported and this composition is reported to have an improved ductility. This composition corresponds in atomic percent to $Ti_{50}Al_{49.97}B_{0.03}$.

5. S. M. L. Sastry, and H. A. Lispitt, "Plastic Deformation of TiAl and $Ti_3Al$", Titanium 80 (Published by American Society for Metals, Warrendale, PA), Vol. 2 (1980) page 1231.
6. Patrick L. Martin, Madan G. Mendiratta, and Harry A. Lispitt, "Creep Deformation of TiAl and TiAl+W Alloys", Metallurgical Transactions A, Vol. 14A (October 1983) pp. 2171-2174.
7. Tokuzo Tsujimoto, "Research, Development, and Prospects of TiAl Intermetallic Compound Alloys", Titanium and Zirconium, Vol. 33, No. 3, 159 (July 1985) pp. 1-13.
8. H. A. Lispitt, "Titanium Aluminides - An Overview", Mat. Res. Soc. Symposium Proc., Materials Research Society, Vol. 39 (1985) pp. 351-364.
9. S. H. Whang et al., "Effect of Rapid Solidification in $Ll_o$ TiAl Compound Alloys", ASM Symposium Proceedings on Enhanced Properties in Struc. Metals Via Rapid Solidification, Materials Week (October 1986) pp. 1-7.
10. Izvestiya Akademii Nauk SSR, Metally. No. 3 (1984) pp. 164-168.
11. P. L. Martin, H. A. Lispitt, N. T. Nuhfer and J. C. Williams, "The Effects of Alloying on the Microstructure and Properties of $Ti_3Al$ and TiAl", Titanium 80 (published by the American Society of Metals, Warrendale, Pa), Vol. 2 (1980) pp. 1245-1254.
12. D. E. Larsen, M. L. Adams, S. L. Kampe, L. Christodoulou, and J. D. Bryant, "Influence of Matrix Phase Morphology on Fracture Toughness in a Discontinuously Reinforced XD™ Titanium Aluminide Composite", Scripta Metallurgica et Materialia, Vol. 24, (1990) pp. 851-856.
13. J. D. Bryant, L. Christodoulou, and J. R. Maisano, "Effect of $TiB_2$ Additions on the Colony Size of Near Gamma Titanium Aluminides", Scripta Metallurgica et Materialia, Vol. 24 (1990) pp. 33-38.

A number of other patents also deal with TiAl compositions as follows:

U.S. Pat. No. 3,203,794 to Jaffee discloses various TiAl compositions.

Canadian Patent 621884 to Jaffee similarly discloses various compositions of TiAl.

U.S. Pat. No. 4,661,316 (Hashimoto) teaches titanium aluminide compositions which contain various additives.

U.S. Pat. No. 4,842,820, assigned to the same assignee as the subject application, teaches the incorporation of boron to form a tertiary TiAl composition and to improve ductility and strength.

U.S. Pat. No. 4,639,281 to Sastry teaches inclusion of fibrous dispersoids of boron, carbon, nitrogen, and mixtures thereof or mixtures thereof with silicon in a titanium base alloy including TiAl.

European patent application 0275391 to Nishiyama teaches TiAl compositions containing up to 0.3 weight percent boron and 0.3 weight percent boron when nickel and silicon are present.

U.S. Pat. No. 4,774,052 to Nagle concerns a method of incorporating a ceramic, including boride, in a matrix by means of an exothermic reaction to impart a second phase material to a matrix material including titanium aluminides.

A number of commonly owned patents relating to titanium aluminides and to methods and compositions for improving the properties of such aluminides. These patents include U.S. Pat. Nos. 4,836,983; 4,842,819; 4,842,820; 4,857,268; 4,879,092; 4,897,127; 4,902,474, 4,923,534; 4,842,817; 4,916,028; 4,923,534; 5,032,357; and 5,045,406. The texts of these commonly owned patents are incorporated herein by reference.

Commonly owned patent 5,028,491 teaches improvements in titanium aluminides through additions of chromium and tantalum.

Chromium containing TiAl is taught in U.S. Pat. No. 4,842,819.

TiAl containing Cr and Nb is taught in U.S. Pat. No. 4,879,092.

BRIEF DESCRIPTION OF THE INVENTION

In one of its broader aspects, the objects of the present invention can be achieved by providing a melt of a gamma TiAl containing between 46 and 48 atom percent aluminum, a low concentration of between 1 and 3 atom percent chromium, a high concentration between 6 and 14 atom percent niobium, and casting the melt.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
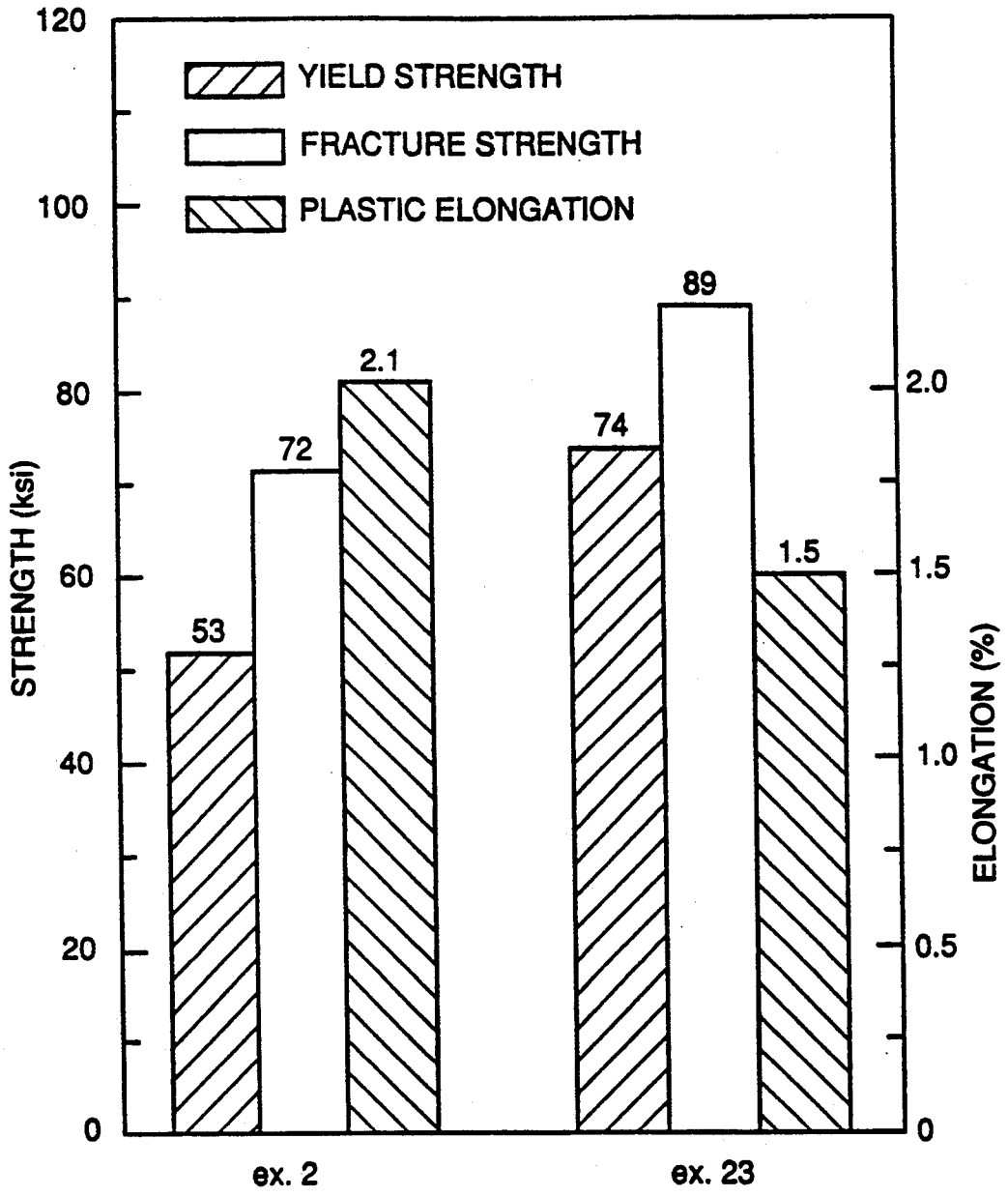
FIG. 1 is a graph depicting the property improvements achieved by practice of the present invention.
Figure 2:
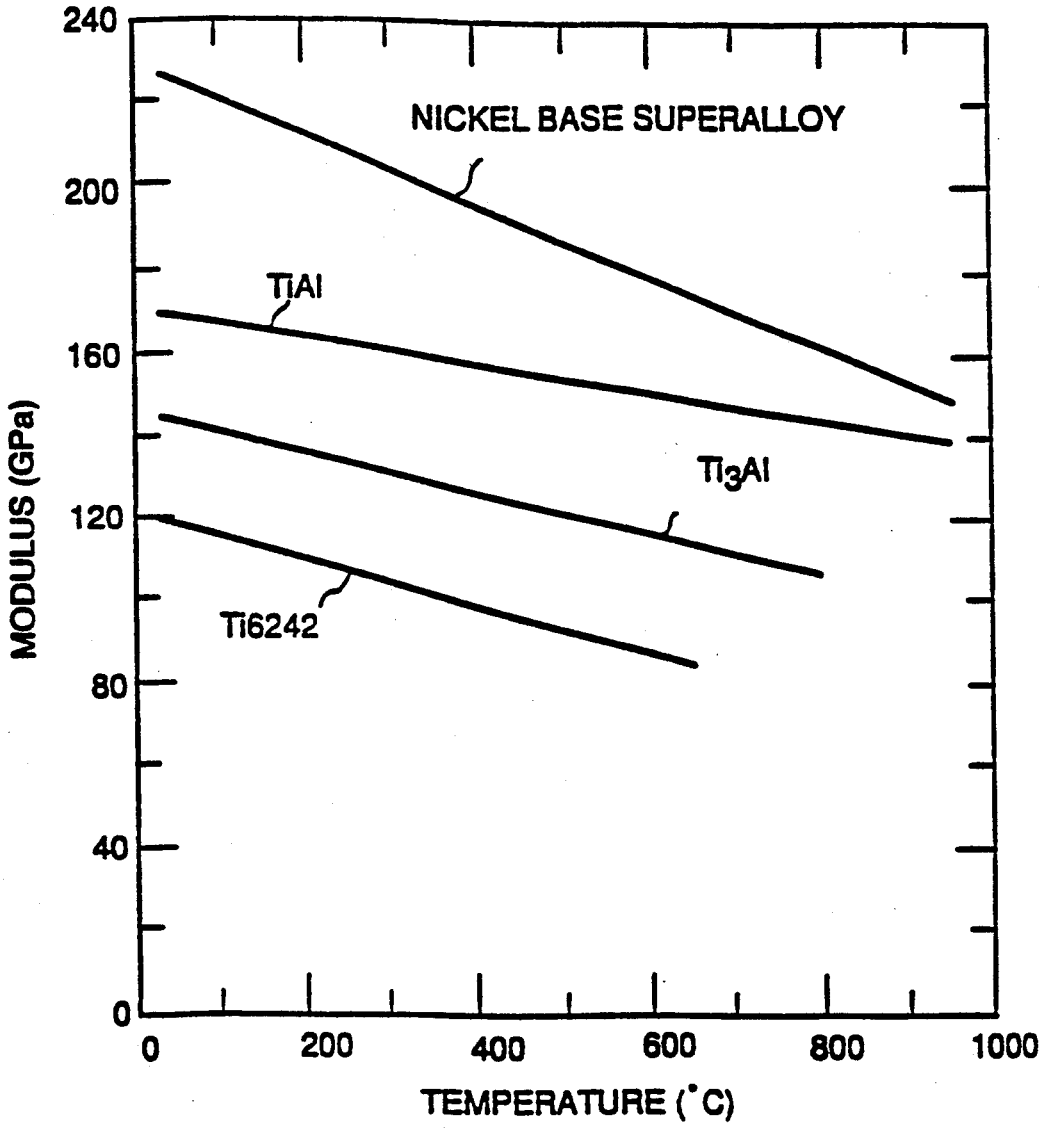
FIG. 2 is a graph illustrating the relationship between modulus and temperature for an assortment of alloys.

It is well known, as is extensively discussed above, that except for its brittleness, the intermetallic compound gamma TiAl would have many uses in industry because of its light weight, high strength at high temperatures and relatively low cost. The composition would have many industrial uses today if it were not for this basic property defect of the material which has kept it from such uses for many years.

Further, it has been recognized that cast gamma TiAl suffers from a number of deficiencies some of which have also been discussed above. These deficiencies include the brittleness of the castings which are formed; the relatively poor strength of the castings which are formed; and a low fluidity in the molten state adequate to permit castings of fine detail and sharp angles and corners in a cast product.

The inventor has now found that substantial improvements in the castability of gamma TiAl and substantial improvements in the cast products can be achieved by modifications of the casting practice as now herein discussed.

To better understand the improvements in the properties of gamma TiAl, a number of examples are presented and discussed to provide a background in the technology involved. This is followed by the examples which deal with the novel processing practice of this invention.

EXAMPLES 1-3

Three individual melts were prepared to contain titanium and aluminum in various binary stoichiometric ratios approximating that of TiAl. Each of the three compositions was separately cast in order to observe the microstructure. The samples were cut into bars and the bars were separately HIPed (hot isostatic pressed) at 1050° C. for three hours under a pressure of 45 ksi. The bars were then individually subjected to different heat treatment temperatures ranging from 1200° to 1375 C. Conventional test bars were prepared from the heat treated samples and yield strength , fracture strength and plastic elongation measurements were made. The observations regarding solidification structure, the heat treatment temperatures and the values obtained from the tests are included in Table I.

As is evident from Table I, the three different compositions contain three different concentrations of aluminum and specifically 46 atomic percent aluminum; 48 atomic percent aluminum; and 50 atomic percent aluminum. The solidification structure for these three separate melts are also listed in Table I, and as is evident from the table, three different structures were formed on solidification of the melt. These differences in crystal form of the castings confirm in part the sharp differences in crystal form and properties which result from small differences in stoichiometric ratio of the gamma TiAl compositions. The Ti-46Al was found to have the best crystal form among the three castings.

Regarding the preparation of the melt and the solidification, each separate ingot was electroarc melted in an argon atmosphere. A water cooled hearth was used as the container for the melt in order to avoid undesirable melt-container reactions. Care was used to avoid exposure of the hot metal to oxygen because of the strong affinity of titanium for oxygen.

Bars were cut from the separate cast structures. These bars were HIPed at 1050° C. for three hours at 45 ksi pressure and were individually heat treated at the temperatures listed in the Table I.

The heat treatment was carried out at the temperature indicated in the Table I for two hours.

From the test data included in Table I, it is evident that the alloys containing 46 and 48 atomic percent aluminum had generally superior strength and generally superior plastic elongation as compared to the alloy composition prepared with 50 atomic percent aluminum. The alloy having the best overall ductility was that containing 48 atom percent aluminum.

EXAMPLES 4-6

The present inventor found that the gamma TiAl compound could be substantially ductilized by the addition of a small amount of chromium. This finding is the subject of a U.S. Pat. No. 4,842,819.

A series of alloy compositions were prepared as melts to contain various concentrations of aluminum together with a small concentration of chromium. The alloy compositions cast in these experiments are listed in Table II immediately below. The method of preparation was essentially that described with reference to Examples 1-3 above.

TABLE I

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 1 | Ti—46Al | large equiaxed | 1200 | 49 | 58 | 0.9 |
| | | | 1225 | * | 55 | 0.1 |
| | | | 1250 | * | 56 | 0.1 |
| | | | 1275 | 58 | 73 | 1.8 |
| 2 | Ti—48Al | columnar | As-HIP'ed | 57 | 69 | 0.9 |
| | | | 1250 | 54 | 72 | 2.0 |
| | | | 1275 | 51 | 66 | 1.5 |
| | | | 1300 | 56 | 68 | 1.3 |
| | | | 1325 | 53 | 72 | 2.1 |
| 3 | Ti—50Al | columnar-equiaxed | As-HIP'ed | 40 | 53 | 1.3 |
| | | | 1250 | 33 | 42 | 1.1 |
| | | | 1325 | 34 | 45 | 1.3 |
| | | | 1350 | 33 | 39 | 0.7 |
| | | | 1375 | 34 | 42 | 0.9 |

*specimens failed elastically

TABLE II

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 4 | Ti—46Al—2Cr | large equiaxed | 1225 | 56 | 64 | 0.5 |
| | | | 1250 | 44 | 53 | 1.0 |
| | | | 1275 | 50 | 59 | 0.7 |
| 5 | Ti—48Al—2Cr | columnar | 1250 | 45 | 60 | 2.2 |
| | | | 1275 | 47 | 63 | 2.1 |
| | | | 1300 | 47 | 62 | 2.0 |
| | | | 1325 | 53 | 68 | 1.9 |
| 6 | Ti—50Al—2Cr | columnar-equiaxed | 1275 | 50 | 60 | 1.1 |
| | | | 1325 | 50 | 63 | 1.4 |
| | | | 1350 | 51 | 64 | 1.3 |
| | | | 1375 | 50 | 58 | 0.7 |

The crystal form of the solidified structure was observed and, as is evident from Table II the addition of chromium did not improve the mode of solidification of the structure of the materials cast and listed in Table I. In particular, the composition containing 46 atomic percent of aluminum and 2 atomic percent of chromium had large equiaxed grain structure. By way of comparison, the composition of Example 1 also had 46 atomic percent of aluminum and also had large equiaxed crystal structure. Similarly for Examples 5 and 6, the addition of 2 atomic percent chromium to the binary composition as listed in Examples 2 and 3 of Table I showed that there was no improvement in the solidification structure of the chromium containing composition over the binary alloy.

Bars cut from the separate cast structures were HIPed and were individually heat treated at temperatures as listed in Table II. Test bars were prepared from the separately heat treated samples and yield strength, fracture strength and plastic elongation measurements were made. In general, the material containing 46 atomic percent aluminum was found to be somewhat less ductile than the materials containing 48 and 50 atomic percent aluminum but otherwise the properties of the three sets of materials were essentially equivalent with respect to tensile strength.

EXAMPLES 7–17

A series of alloy compositions were prepared as melts to contain various concentrations of aluminum together with various concentrations of niobium additive. Eleven such compositions were prepared in all and these constitute the Examples 7–17 of the attached table. The method of preparation was essentially that described above with reference to the Examples 1–6. The compositions as well as the solidification structure of the composition as solidified together with strength and ductility properties are listed in Table III immediately below.

TABLE III

| Ex. No. | Atomic Composition | Solidification Structure | Heat Treat Temp (°C.) | Yield Strength (ksi) | Fracture Strength (ksi) | Plastic Elongation (%) |
|---|---|---|---|---|---|---|
| 7 | Ti—48Al—6Nb | columnar | 1275 | 58 | 69 | 1.2 |
| | | | 1300 | 54 | 68 | 1.6 |
| | | | 1325 | 53 | 70 | 1.9 |
| 8 | Ti—50Al—6Nb | columnar | 1325 | 34 | 44 | 1.4 |
| | | | 1350 | 40 | 48 | 0.9 |
| | | | 1375 | 43 | 52 | 1.1 |
| 9 | Ti—44Al—10Nb | fine equiaxed | 1250 | 109 | 109 | 0.2 |
| | | | 1300 | — | 100 | 0.1 |
| | | | 1350 | — | 102 | 0 |
| 10 | Ti—46Al—10Nb | equiaxed | 1250 | 98 | 99 | 0.3 |
| | | | 1300 | 90 | 90 | 0.2 |
| | | | 1350 | — | 76 | 0.1 |
| 11 | Ti—48Al—10Nb | columnar | 1275 | 62 | 69 | 0.7 |
| | | | 1300 | 60 | 71 | 1.2 |
| | | | 1325 | 59 | 71 | 1.2 |
| 12 | Ti—43Al—12Nb | fine equiaxed | 1250 | — | 102 | 0.1 |
| | | | 1300 | — | 111 | 0.1 |
| | | | 1350 | — | 111 | 0.1 |
| 13 | Ti—44Al—12Nb | fine equiaxed | 1250 | — | 96 | 0 |
| | | | 1300 | — | 105 | 0.1 |
| | | | 1350 | — | 117 | 0 |
| 14 | Ti—46Al—12Nb | equiaxed | 1250 | — | 96 | 0.1 |
| | | | 1300 | — | 95 | 0.1 |
| | | | 1350 | — | 100 | 0.1 |
| 15 | Ti—50Al—12Nb | columnar | 1325 | 45 | 50 | 0.6 |
| | | | 1350 | 45 | 53 | 1.0 |
| | | | 1375 | 47 | 57 | 1.2 |
| 16 | Ti—44Al—16Nb | fine equiaxed | 1275 | — | 98 | 0 |
| | | | 1300 | — | 92 | 0 |
| | | | 1350 | 104 | 104 | 92 |
| 17 | Ti—48Al—16Nb | equiaxed | 1275 | — | 61 | 0 |
| | | | 1300 | — | 59 | 0 |
| | | | 1325 | 64 | 68 | 0.3 |

The alloys of Examples 7–17 were each prepared by casting and HIPing and are in this sense similar to the alloys of the Examples 1-6 above which were also prepared by casting and HIPing.

As a separate matter a set of examples concerned with a relatively high concentration of niobium additive in TiAl alloys is set out in copending application Ser. No. 07/695,043, filed May 2, 1991. The alloys of the copending application were prepared by wrought processing rather than by the cast and HIP processing of the subject application.

Returning now to the subject application, the Examples 10 and 14 of the above Table III of this application are comparable to Examples 1 and 4 of this application as given above in that they each contain 46 atom percent of aluminum. For these examples, it will be noted that the niobium additions did not affect the solidification structure in that in each case the structure was equiaxed. Further, in these Examples 10 and 14, there is a significant increase in the strength when compared to the results obtained in Examples 1 and 4 but, at the same time, there is a very significant decrease in ductility to essentially unacceptable levels.

The Examples 7, 11, and 17 of the accompanying Table III are comparable to Examples 2 and 5 above in that in each of these examples the aluminum concentration is 48 atom percent. It will be observed from the tabulated results that the niobium additions do not result in a significant effect on solidification structure in that the structure for the Examples 7 and 11 were found to be columnar and in this way conform to the structure found for the Examples 2 and 5 above. However, the addition of 16 atom percent niobium according to Example 17 does result in a change of the solidification structure from columnar to equiaxed.

For these Examples 7, 11, and 17, niobium additions did increase the strength marginally but these increases in strength cannot be justified by the accompanying increase in density of the alloy.

These niobium additions also resulted in a reduction in ductility. However, at the 6 and 10 atom percent level of niobium addition (for Examples 7 and 11), the ductility can still be maintained at a level of greater than 1. By contrast, at the 16 atom percent niobium level of Example 17, the ductility is significantly impaired and is at an unacceptably low level.

Next, the Examples 8 and 15 are comparable to Examples 3 and 6 above in that in each of these examples the aluminum concentration is at 50 atom percent. It will be observed for the results reported in Table III for Examples 8 and 15 that there is no significant gain for either strength or ductility from the additions of niobium at the levels indicated for Examples 8 and 15.

In summary, the niobium increased the strength and reduced the ductility slightly except at the very high level of about 16 atom percent. The properties are very sensitive to aluminum concentration at concentrations of 46 atom percent and below.

For example, it is noted from the above data that compositions containing only the niobium additive and having 46 or less atom percent of aluminum have very high strength but tend to be brittle. It is also noted that at aluminum levels of 50 atom percent or above the alloys are weak. Accordingly, it is observed that the alloys having about 48 atom percent of aluminum are the optimal compositions when niobium is the only additive present.

Further it is noted that the sensitivity of properties to aluminum concentration are much stronger for compositions which contain the niobium additive than they are for the binary compositions of Examples 1-3 or the chromium containing examples of Examples 4-6.

Further, from the above data it is evident that the properties of the niobium containing compositions are not significantly affected by the temperature of heat treatment.

EXAMPLES 18-24

A series of additional alloy compositions were prepared as melts to contain various concentrations of aluminum together with the various concentrations of both chromium and niobium additives. Seven such compositions were prepared in all and these constitute the Examples 18-24 of the attached Table IV. The method of preparation was essentially that described above with reference to the above examples 1-17. Compositions as well as the solidification structure of the compositions as solidified together with strength and ductility properties are listed in Table IV immediately below.

EXAMPLES 18-24

TABLE IV

| Ex. No. | Atomic Composition | Solidification Structure | Heat Treat Temp (°C.) | Yield Strength (ksi) | Fracture Strength (ksi) | Plastic Elongation (%) |
|---|---|---|---|---|---|---|
| 18 | Ti—48Al—2Cr—6Nb | large equiaxed | As-HIPed | 57 | 69 | 1.9 |
| | | | 1250 | 52 | 62 | 1.3 |
| | | | 1300 | 57 | 67 | 1.1 |
| | | | 1325 | 63 | 77 | 1.8 |
| | | | 1350 | 63 | 76 | 1.5 |
| 19 | Ti—44Al—2Cr—8Nb | fine equiaxed | 1200 | 81 | 96 | 0.5 |
| | | | 1225 | 85 | 88 | 0.3 |
| | | | 1275 | 82 | 87 | 0.3 |
| 20 | Ti—46Al—2Cr—8Nb | equiaxed | 1225 | 71 | 80 | 0.6 |
| | | | 1250 | 70 | 80 | 0.7 |
| | | | 1275 | 69 | 79 | 0.6 |
| | | | 1300 | 70 | 82 | 0.8 |
| 21 | Ti—47Al—2Cr—8Nb | columnar | 1250 | 59 | 69 | 0.8 |
| | | | 1275 | 57 | 68 | 0.8 |
| | | | 1300 | 58 | 71 | 1.1 |
| | | | 1325 | 61 | 75 | 1.2 |
| | | | 1350 | 67 | 78 | 1.1 |
| 22 | Ti—46Al—2Cr—12Nb | equiaxed | 1225 | — | 73 | 0.1 |
| | | | 1250 | 70 | 77 | 0.7 |
| | | | 1275 | 65 | 74 | 0.6 |
| | | | 1300 | 64 | 72 | 0.6 |
| | | | 1325 | 64 | 76 | 0.7 |

TABLE IV-continued

| Ex. No. | Atomic Composition | Solidification Structure | Heat Treat Temp (°C.) | Yield Strength (ksi) | Fracture Strength (ksi) | Plastic Elongation (%) |
|---|---|---|---|---|---|---|
| 23 | Ti—48Al—2Cr—12Nb | columnar | As-HIPed | 64 | 77 | 1.2 |
| | | | 1250 | 60 | 74 | 1.3 |
| | | | 1300 | 78 | 91 | 1.2 |
| | | | 1325 | 85 | 95 | 1 |
| | | | 1350 | 74 | 89 | 1.5 |
| 24 | Ti—46Al—2Cr—16Nb | fine equiaxed | 1225 | — | 70 | 0 |
| | | | 1250 | — | 67 | 0.1 |
| | | | 1275 | — | 59 | 0 |
| | | | 1300 | — | 60 | 0 |
| | | | 1325 | — | 58 | 0 |

As indicated above, the alloys of Examples 18–24 are prepared by a cast and hip processing as are the Examples 1–17.

As is noted from the examples above, samples 4–6 dealt with compositions which had only chromium additives and examples 7–17 dealt with compositions which had only niobium additive to the binary alloy. The examples of Table IV deal with compositions which contain both chromium and niobium additives. But more than the identification of the additives, the compositions of the examples 18–24 deal with a combination of chromium and niobium additives in which the chromium is lower and the niobium is higher. As is evident from the compositions listed in Table IV, the chromium in each example remains at the 2 atom percent level whereas the niobium concentration is varied from 6–16 atom percent.

Considering now the data developed from specific examples, the examples 18 and 23 are those which contain 48 atom percent of aluminum. The increase in niobium from 6 to 12 atom percent for these two examples results in an increase in the strength of the composition but also results in a reduction in the ductility for these compositions.

With regard now to the data developed from Examples 20, 22 and 24, these three examples have in common that the aluminum concentration is at the 46 atom percent level. For each of these examples it will be observed that the increased niobium level results in a slightly increased strength but also in a reduced ductility and this reduction becomes particularly acute where the niobium level reaches the 16 atom percent level.

By considering Examples 19, 20 and 21 together it is evident that there is no increase in either the chromium or niobium concentrations but that the aluminum concentration is increased from 44 to 47 atom percent. This increase in the aluminum concentration tends to promote the formation of the columnar structure and the composition with the 47 atom percent aluminum level has a columnar structure.

Further, for the compositions of Examples 19, 20 and 21 there is a reduction in strength as the aluminum concentration is increased and there is also an increase in the ductility.

With regard now next to the comparison of the results for Examples 22 and 23, in this case the chromium and niobium concentrations are maintained constant but the aluminum concentration is increased from 46 to 48 atom percent. The observations given above with regard to Examples 19, 20 and 21 relating to the increase in aluminum concentration are found to apply as well to the comparison of the results for the examples 22 and 23 where the increase in aluminum concentration results in the tendency toward formation of the columnar structure as well as an increase in the ductility. However, for examples 22 and 23 it will be observed that there is no decrease in strength but rather there is an increase particularly at the higher heat treatment temperatures. This substantiates the finding that the 48 atom percent of aluminum is an optimal level.

Further, from comparison of results obtained for Examples 18, 21 and 23 it is evident that the 48 atom percent of aluminum (47 atom percent for Example 21) the maximum level of ductility is achieved. Further, it is clear that a significant strength accompanies the higher level of ductility. In general, the desirable aluminum concentration levels is from 46 to 48 atom percent with the optimal being at the upper end of this range.

Example 23 illustrates that the properties are affected by heat treatment and both the strength and ductility can be improved by heat treatment at the 1300°–1350° C. range. A property comparison between the results obtained in Example 2 and Example 23 is shown in FIG. 1.

Based on the results set forth in Example 24 it is evident that the 16 atom percent niobium value is too high and accordingly the desirable property levels are achieved in the niobium additive range of about 6–14 atom percent. Throughout these examples the chromium concentration has been maintained at the low level and the value of the chromium concentration based on these experiments is accordingly determined to be between 1 and 3 atom percent.

What is claimed is:

1. A castable composition comprising titanium, aluminum, chromium, and niobium in the following approximate composition:

$$Ti—Al_{46—48}Cr_{1—3}Nb_{6—14}.$$

said alloy having been prepared by cast and HIP processing.

2. A castable composition comprising titanium, aluminum, chromium, and niobium in the following approximate composition:

$$Ti—Al_{48}Cr_{1—3}Nb_{6—14}.$$

said alloy having been prepared by cast and HIP processing.

3. A castable composition comprising titanium, aluminum, chromium, and niobium in the following approximate composition:

$$Ti—Al_{46—48}Cr_{2}Nb_{6—14}.$$

said alloy having been prepared by cast and HIP processing.

4. A castable composition comprising titanium, aluminum, chromium, and niobium in the following approximate composition:

$$Ti—Al_{46—48}Cr_2Nb_{8—12}.$$

said alloy having been prepared by cast and HIP processing.

5. A castable composition comprising titanium, aluminum, chromium, and niobium in the following approximate composition:

$$Ti—Al_{48}Cr_{1—3}Nb_{8—12}.$$

said alloy having been prepared by cast and HIP processing.

6. A castable composition comprising titanium, aluminum, chromium, and niobium in the following approximate composition:

$$Ti—Al_{48}Cr_2Nb_{8—12}.$$

said alloy having been prepared by cast and HIP processing.

7. A structural element, said element being a casting of a composition having the following approximate composition:

$$Ti—Al_{46—48}Cr_{1—3}Nb_{6—14}.$$

said alloy having been prepared by cast and HIP processing.

8. A structural element, said element being a casting of a composition having the following approximate composition:

$$Ti—Al_{48}Cr_{1—3}Nb_{6—14}.$$

said alloy having been prepared by cast and HIP processing.

9. A structural element, said element being a casting of a composition having the following approximate composition:

$$Ti—Al_{46—48}Cr_2Nb_{6—14}.$$

said alloy having been prepared by cast and HIP processing.

10. A structural element, said element being a casting of a composition having the following approximate composition:

$$Ti—Al_{46—48}Cr_2Nb_{8—12}.$$

said alloy having been prepared by cast and HIP processing.

11. A structural element, said element being a casting of a composition having the following approximate composition:

$$Ti—Al_{48}Cr_{1—3}Nb_{8—12}.$$

said alloy having been prepared by cast and HIP processing.

12. A structural element, said element being a casting of a composition having the following approximate composition:

$$Ti—Al_{48}Cr_2Nb_{8—12}.$$

said alloy having been prepared by cast and HIP processing.

* * * * *